United States Patent [19]

Sheffer

[11] Patent Number: 4,630,551

[45] Date of Patent: Dec. 23, 1986

[54] EXECUTIVE DESK

[75] Inventor: Phil B. Sheffer, New Oxford, Pa.

[73] Assignee: Merchandising Innovations, Inc., Hanover, Pa.

[21] Appl. No.: 813,568

[22] Filed: Dec. 26, 1985

[51] Int. Cl.[4] ..... A47B 3/06

[52] U.S. Cl. ..... 108/159; 108/111; 312/195

[58] Field of Search ..... 108/159, 153, 111; 297/442, 403; 312/259, 262, 195; 5/DIG. 1

[56] References Cited

U.S. PATENT DOCUMENTS

| | | | |
|---|---|---|---|
| 1,930,348 | 10/1933 | Parrott | 312/195 X |
| 3,337,983 | 8/1967 | Ebstein | 312/195 X |
| 3,866,549 | 2/1975 | Berton | 312/195 |
| 3,871,726 | 3/1975 | Stegner | 312/195 |

*Primary Examiner*—James T. McCall

*Attorney, Agent, or Firm*—Daniel J. O'Connor

[57] ABSTRACT

An executive desk apparatus and kit assembly wherein the component parts are made entirely of factory precut corrugated fiberboard. The desk component part design allows all parts to be shipped in a flat or knock-down position to reduce shipping costs. The unique engineering design allows all component parts to be easily slid together in interfitting relationship without the need for tools or complex assembly techniques so that the product will have widespread utility for home-owners and other consumers. Although easy to assemble, the inventive design results in a highly durable and attractive end product suitable for executive or home office uses.

1 Claim, 2 Drawing Figures

EXECUTIVE DESK

Papers relating to the present invention were previously filed under the Disclosure Document Program of the U.S. Patent Office.

BACKGROUND OF THE INVENTION

This invention relates generally to an assembly technique and assembly construction of a large style executive desk which is fabricated entirely of corrugated fiberboard.

The use of paperboard knockdown furniture items is known in the prior art. Typically, however, such furniture items have suffered the drawbacks of requiring complex assembly procedures and of not being durable in structure or appearance upon assembly.

Such limitations have severely restricted the market sales for paperboard products generally.

Cited as exemplary of prior art systems is that of U.S. Pat. No. 3,866,550 issued to Greschwender. As shown in the disclosure, the patent requires the use of external extrusion covers and or tape to complete the assembly. Further, the U.S. Pat. No. 3,866,550, as is typical of prior art systems in this art, uses such a thin paperboard wall structure that end product durability is impossible to achieve.

Thus, in most prior art systems, the consumer is faced with hours of assembly time for an end product which may not be durable, attractive or suitable for its intended use.

OBJECTS OF THE INVENTION

Accordingly, it is an object of the present invention to provide a desk furniture apparatus and kit in which all component parts may be shipped in a flat or knockdown condition to reduce shipping and warehousing costs.

It is a further object to provide an executive desk model which, although made entirely of lightweight corrugated fiberboard materials, is highly durable and sturdy in use.

It is a further object to provide an executive desk kit which may be readily assembled by unskilled personnel or by consumers unfamiliar with furniture assembly techniques.

It is also an object to provide a novel method of desk furniture assembly wherein the component parts are factory pre-cut and factory pre-glued in a unique design which permits a highly stable joining of said parts without the use of fasteners.

Further objects and advantages of the present invention will become apparent as the following description proceeds, and the features of novelty characterizing the invention will be pointed out with particularity in the claims annexed to and forming a part of this specification.

BRIEF DESCRIPTION OF THE DRAWING FIGURES

SUMMARY OF THE INVENTION

The invention kit assembly consists of three major component parts.

First, a vertical side wall assembly is comprised of stacked and factory pre-glued corrugated fiberboard layers. The vertical side wall assembly has narrow channels factory formed therein so as to receive the body portion of a pedestal stabilizer. It also has wider channels formed therein to receive, in a locking relationship, the flaps which are formed on the pedestal stabilizer.

Second, the kit assembly includes a pedestal stabilizer means which also includes multiple layers of corrugated fiberboard. The detailed construction of the pedestal stabilizer is described in a related U.S. patent application. For the present invention, it is sufficient to note that the pedestal stabilizer has a body portion of plural corrugated fiberboard layers and end flaps for interlocking with the channels formed in the vertical side wall assembly.

Third, the kit assembly includes a desk top construction having multiple layers of factory pre-glued corrugated fiberboard. The lower layers of the desk top have portions cut away and factory sized so that the desk top may be simply dropped onto the combined vertical side wall and pedestal stabilizer assembly. The desk top cut away portions are sized so that the top cannot be moved horizontally once it has been placed in its desired position.

It is to be understood that, in sale of the invention device, each kit would include two vertical side wall components, two pedestal stabilizers and one desk top element.

FULL DESCRIPTION OF THE PREFERRED EMBODIMENT

Figure 1:
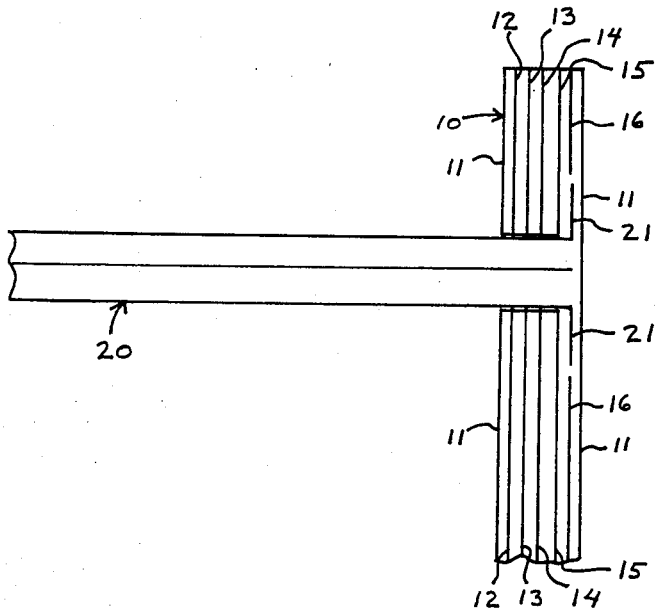
FIG. 1 shows an elevation schematic view of the method of interconnecting the pedestal stabilizer to the vertical side wall. The layer construction and channels of the vertical side wall are shown as well as the end flap construction of the pedestal stabilizer.

Referring now to drawing FIG. 1, the executive desk vertical side wall 10 is shown as having an outer wrapping layer 11 of corrugated fiberboard.

Inner layers 12, 13, 14 and 15 are formed of double layer corrugated fiberboard.

A further inner layer 16 consists of single layer corrugated fiberboard.

As shown, each of the double corrugated layers 12, 13, 14 and 15 have channels cut therein to receive the width of a pedestal stabilizer 20.

Pedestal stabilizer 20 has bendable flaps 21 formed thereon as an extension of its outer wrapping layer. To receive flaps 21 upon assembly, wider channels are precut in the single corrugated layer 16 of vertical side wall 10.

It will thus be appreciated that pedestal stabilizer 20 can be simply slid into the channels of the vertical side wall 10 and will be retained, securely locked in position, by means of the connection assembly shown. Significantly, no separate fasteners are required in assembly of the executive desk.

The entire base for the executive desk comprises two vertical side walls 10 and two pedestal stabilizers 20, said components being interconnected in the same fashion as above described.

The invention desk top 30 is designed and factory precut in such a way that it can simply be dropped onto the desk base formed by elements 10 and 20 without the need for fasteners.

Figure 2:
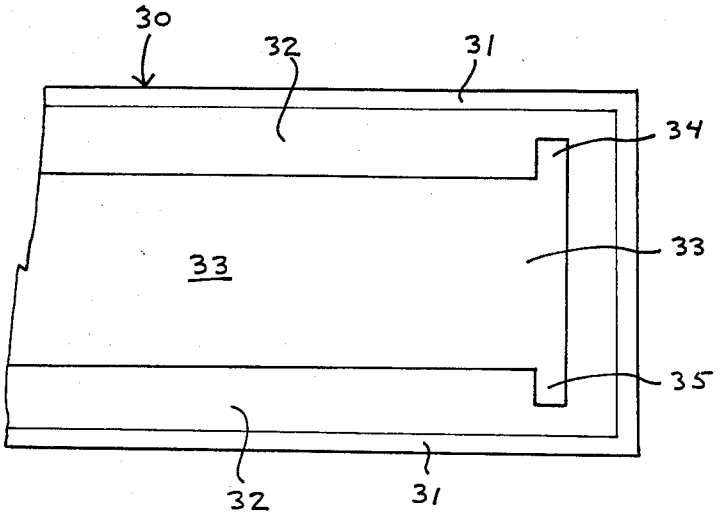
FIG. 2 is an elevation view of the underside of the desk top component showing the areas where the lower corrugated fiberboard layers are cut away to allow the desk top to be positioned onto the lower vertical side walls and pedestal stabilizers.

The desk top 30, shown from its underside in FIG. 2, comprises an outer decorative wrapping layer 31. Zone 32 of the desk top 30 comprises four layers of double corrugated fiberboard stacked on each other and factory preglued. In zone 33 of the desk top 30, two of the four layers of the double corrugated fiberboard have been cut away to form the "T" section indicated at 34 and 35.

The "T" section of the desk top 30 is sized so that it may be snugly dropped over the connections formed by the vertical side wall 10 and the pedestal stabilizer 20. When thus positioned, the desk top 30 cannot be moved horizontally.

It will thus be appreciated that a highly durable executive desk is formed from light weight materials which may be shipped in a flat position to reduce shipping and warehousing costs. A further significant advantage of the invention is that the component parts may be easily assembled by anyone without the need for separate mechanical fasteners.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. An executive desk assembly kit comprising three distinct component parts as follows:

a vertical side wall assembly (10) comprising multiple factory pre-glued layers of corrugated fiberboard (12,13,14,15,16), wherein said vertical side wall layers include factory pre-formed narrow channel means for receipt of pedestal stabilizer means (20) and wider channel means for receipt of flaps (21) formed on said pedestal stabilizer means (20), a pedestal stabilizer means (20) having flaps (21) formed on the ends thereof, said pedestal stabilizer means being sized so as to slidably interfit with the channel means of the vertical side wall assembly whereby a joinder is accomplished without the need for separate mechanical fasteners, a desk top assembly (30) comprising plural factory pre-glued layers of corrugated fiberboard, wherein at least one lower layer of said desk top assembly has cut-away section means (33) for interfitting with the vertical side wall assembly (10) and the pedestal stabilizer means (20), wherein said vertical side wall assembly (10) comprises:

a first outer wrapping layer (11) made of corrugated fiberboard, a second layer (12) comprised of double wall corrugated fiberboard, a third layer (13) comprised of double wall corrugated fiberboard, a fourth layer (14) comprised of double wall corrugated fiberboard, a fifth layer (15) comprised of double wall corrugated fiberboard, a sixth layer (16) comprised of single wall corugated fiberboard, and means wherein each of said layers (11–16) are factory pre-glued together for finished use in the executive desk assembly kit, wherein said first outer wrapping layer (11) and all of said double wall corrugated layers (12–15) of said vertical side wall assembly have a narrow channel means factory pre-formed therein for receipt of a body portion of a pedestal stabilizer means (20), wherein said sixth layer (16) of said vertical side wall assembly (10) comprising single wall corrugated fiberboard has widened channel means factory preformed therein for receipt of flap means (21) formed on the end portion of a pedestal stabilizer means (20), said widened channel means being wider than said narrow channel means formed in said double wall corrugated layers (12–15), wherein said pedestal stabilizer means (20) is made entirely of corrugated fiberboard material and wherein said flaps (21) formed thereon are bendable so as to allow said pedestal stabilizer means (20) to a slidably interfit with the narrow and wider channel means formed in the corrugated fiberboard layers of said vertical side wall assembly (10).

* * * * *